United States Patent [19]

Greene, Jr.

[11] Patent Number: 5,020,508

[45] Date of Patent: Jun. 4, 1991

[54] APPARATUS FOR SELECTIVELY RELEASING A BOWSTRING OF AN ARCHERY BOW

[76] Inventor: John F. Greene, Jr., Rte. 2, Box 300, Boone, N.C. 28607

[21] Appl. No.: 479,987

[22] Filed: Feb. 14, 1990

[51] Int. Cl.[5] ..... F41B 5/00

[52] U.S. Cl. ..... 124/35.2

[58] Field of Search ..... 124/31, 35.1, 35.2, 124/90

[56] References Cited

U.S. PATENT DOCUMENTS

| | | | |
|---|---|---|---|
| 2,417,791 | 3/1947 | Tyszkiewicz | 124/35.2 |
| 2,488,597 | 11/1949 | Konold | 124/35.2 |
| 2,637,311 | 5/1953 | Rose | 124/35.2 |
| 2,819,707 | 1/1958 | Kayfes et al. | 124/35.2 |
| 2,936,749 | 5/1960 | Chellstorp | 124/35.1 |
| 2,965,093 | 12/1960 | Arsenault | 124/35.2 |
| 2,977,952 | 4/1961 | Gabriel et al. | 124/35.2 |
| 4,282,851 | 8/1981 | Lyons | 124/35.2 |
| 4,722,319 | 2/1988 | Brady | 124/35.2 |

*Primary Examiner*—Dennis L. Taylor
*Assistant Examiner*—Jeffrey L. Thompson
*Attorney, Agent, or Firm*—Shefte, Pinckney & Sawyer

[57] ABSTRACT

A bowstring release for balanced release of the bowstring of an archery bow includes a pair of movable jaw members. Each jaw member includes a pair of lower and upper engagement portions spaced from one another in the linear direction of the bowstring in its uncocked disposition. The upper and lower engagement portions of the jaw members are movable into engagement with the bowstring above and below the vertical midpoint of the bowstring. Accordingly, when the nock of the arrow is disposed at the vertical midpoint of the bowstring, the bowstring release device applies substantially equal drawing force to the bowstring above and below the nock of the arrow during cocking of the bowstring and simultaneously releases and bowstring with a balanced release.

7 Claims, 3 Drawing Sheets

APPARATUS FOR SELECTIVELY RELEASING A BOWSTRING OF AN ARCHERY BOW

BACKGROUND OF THE INVENTION

The present invention relates to an apparatus for selectively releasing the bowstring of an archery bow.

It is known to provide a mechanical aid for an archer for moving the bowstring of an archery bow between an uncocked disposition in which the bowstring extends linearly to a cocked disposition in which the bowstring is flexed against the tension of the bow for propelling an arrow supported on the bowstring. The arrow includes a notched end portion commonly referred to as a nock which is configured to receive the bowstring therein to insure stability of the arrow during cocking of the bowstring and smooth transfer of the propulsion force from the bowstring to the arrow when the bowstring is released. One type of mechanical aid for smoothly releasing a bowstring includes a means for releasably securing the bowstring and a trigger for effecting movement of the releasable securing means to permit smooth release of the bowstring. Todd U.S. Pat. No. 4,403,594 and Hamm U.S. Pat. No. 4,485,798 disclose bowstring releases of this type.

The bowstring release disclosed in the Todd patent includes a caliper-type bowstring engaging means generally comprising a pair of jaw members movable laterally opposite one another with respect to the bowstring to selectively engage the bowstring therebetween. The caliper jaws are typically moved into bowstring engaging disposition with one another at a position immediately to one side of the nock of the arrow.

The nock of the arrow is preferably disposed at the midpoint of the bowstring to insure that the flight of the arrow is as true as possible. Although the displacement of the caliper-type jaws with respect to the midpoint of the bowstring is relatively negligible, the archer must nonetheless compensate for the offset of the caliper-type jaws by applying, for example, a slight, equally opposite force in the opposite direction to counterbalance the slight force arising from the offset disposition of the caliper type jaws with respect to the midpoint of the bowstring. Otherwise, the arrow will experience axial wobble or tilting on its release.

Accordingly, the need exists for a mechanical bowstring release which optimizes the uniform application of force by the bowstring to the arrow upon release of the bowstring.

SUMMARY OF THE INVENTION

The present invention provides a mechanical bowstring release which optimizes the uniform release of a bowstring to apply a balanced force by the bowstring to an arrow.

Briefly described, the present invention provides a trigger apparatus for selectively releasing a bowstring of an archery bow from a cocked disposition to propel an arrow engaged thereon, the arrow being of the type having a nock engaging the bowstring and the bowstring being of the type extending linearly in an uncocked disposition of the archery bow and being movable from the uncocked disposition to the cocked disposition in an arrow cocking direction opposite to the direction of flight of the arrow. The trigger apparatus includes a first jaw means having an upper engagement portion and a lower engagement portion spaced from the upper engagement portion relative to the linear direction of the bowstring, the upper and lower engagement portions of the first jaw means defining a linearly extending gap therebetween an a second jaw means having an upper engagement portion and a lower engagement portion spaced from the upper engagement portion relative to the linear direction of the bowstring, the upper and lower engagement portions of the second jaw means defining a linearly extending gap therebetween. Additionally, the trigger apparatus includes means for supporting the first and second jaw means in opposed lateral disposition for movement of the first and second jaw means in respective opposite directions laterally of the bowstring and means for individually moving &he first and second jaw means in laterally opposite directions.

The moving means moves the first and second jaw means between a bowstring drawing disposition in which the respective upper and lower engagement portions are in generally aligned relation with one another forwardly of the bowstring relative to the direction of flight of the arrow and one in bowstring engaging disposition, and in which the upper and lower engagement portions define a receiving space therebetween for receiving the nock of the arrow therein upon engagement of the bowstring by the nock, and a bowstring release disposition to which the first and second jaw means have been moved laterally oppositely substantially simultaneously by the moving for balanced release of the bowstring for propulsion of the arrow thereby, the trigger apparatus being movable, in the bowstring drawing disposition, to draw the bowstring into a cocked disposition.

In the preferred embodiment of the trigger apparatus of the present invention, the upper and lower engagement portions of the first jaw means are integrally formed and the upper and lower engagement portions of the second jaw means are integrally formed. Additionally, the upper and lower engagement portions of the first and second jaw means include complementary recesses for engaging the bowstring in the bowstring drawing disposition. The first and second jaw means include bowstring engaging surfaces forming the leading surfaces of the complementary recesses relative to the direction of travel of the arrow.

In the preferred embodiment, the bowstring first and second engaging surfaces have relief contours adjacent the receiving space. Additionally, the linearly extending gaps extend lower engagement portions of the first and second jaw means defining the gaps. The means for supporting the first and second jaw means includes a pair of pivotal components, each pivotal component pivotally mounting a respective one of the first and second jaw means for pivotal movement of the respective jaw means about a pivoting axis generally parallel to the linear direction of the bowstring. Furthermore, the moving means includes biasing means disposed between the first and second jaw means for biasing the first and second jaw means into the bowstring release disposition.

The present invention also provides an apparatus for applying a generally balanced drawing force to a bowstring of an archery bow, the bowstring being of the type for receiving the nock of an arrow thereon generally axially centrally of the bowstring for propulsion of the arrow by the bowstring following cocking of the bowstring. The apparatus includes means for simultaneously engaging the bowstring above and below the nock receiving portion of the bowstring for applying a substantially balanced drawing force to the bowstring above and below the nock receiving portion, and engaging means including a pair of upper jaw portions movable laterally relative to one another into facing contact with one another for presenting a bowstring engagement profile for engaging the bowstring. The apparatus additionally includes a pair of lower jaw portions movable laterally relative to one another into facing contact with one another for presenting a bowstring engagement profile for engaging the bowstring, the upper and lower jaw portions defining therebetween a nock receiving space for receiving the nock of the arrow therein when the nock is received on the bowstring and means, secured to upper and lower jaw portions, for selectively simultaneously releasing the upper and lower jaw portions from their facing contact dispositions to release the bowstring.

DETAILED DESCRIPTION OF THE PREFERRED EMBODIMENT

In FIGS. 1–5, the preferred embodiment of the bowstring release apparatus of the present invention is illustrated and is generally designated as 10. The bowstring release apparatus 10 is adapted to selectively engage a bowstring 12 of a conventional archery bow 14 for movement of the bowstring 12 between an uncocked disposition 12A (shown in broken lines in FIG. 1) and a cocked disposition (shown in solid lines in FIG. 1) and for releasing the bowstring 12 from its cocked disposition to effect propulsion of an arrow 16 by the archery bow 14.

Figure 5:
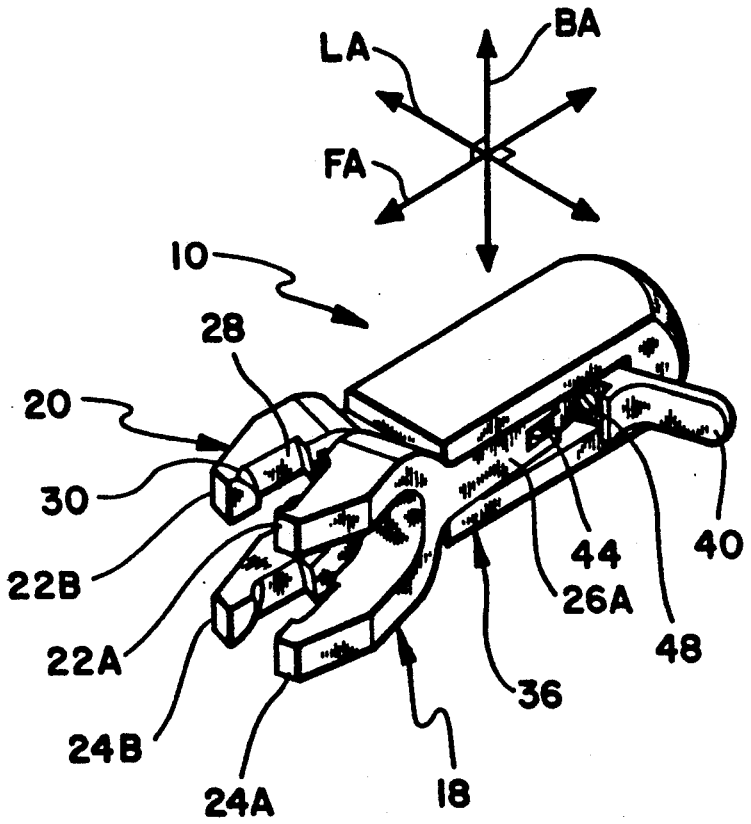
FIG. 5 is a perspective view of the bowstring release apparatus shown in FIGS. 1–4 in its bowstring release disposition.

A frame of reference is provided in FIG. 5 for enhancing the understanding of the various components discussed hereafter. The axis parallel to the axial or linear direction of the bowstring 12 in its uncocked disposition 12A is generally referred to as the linear axis BA. The axis perpendicular to the linear axis BA is referred to as the axis LA. The axis parallel to the flight of the arrow 16 which is perpendicular to the lateral axis LA and the linear axis BA is referred to as the flight axis FA.

Figure 1:
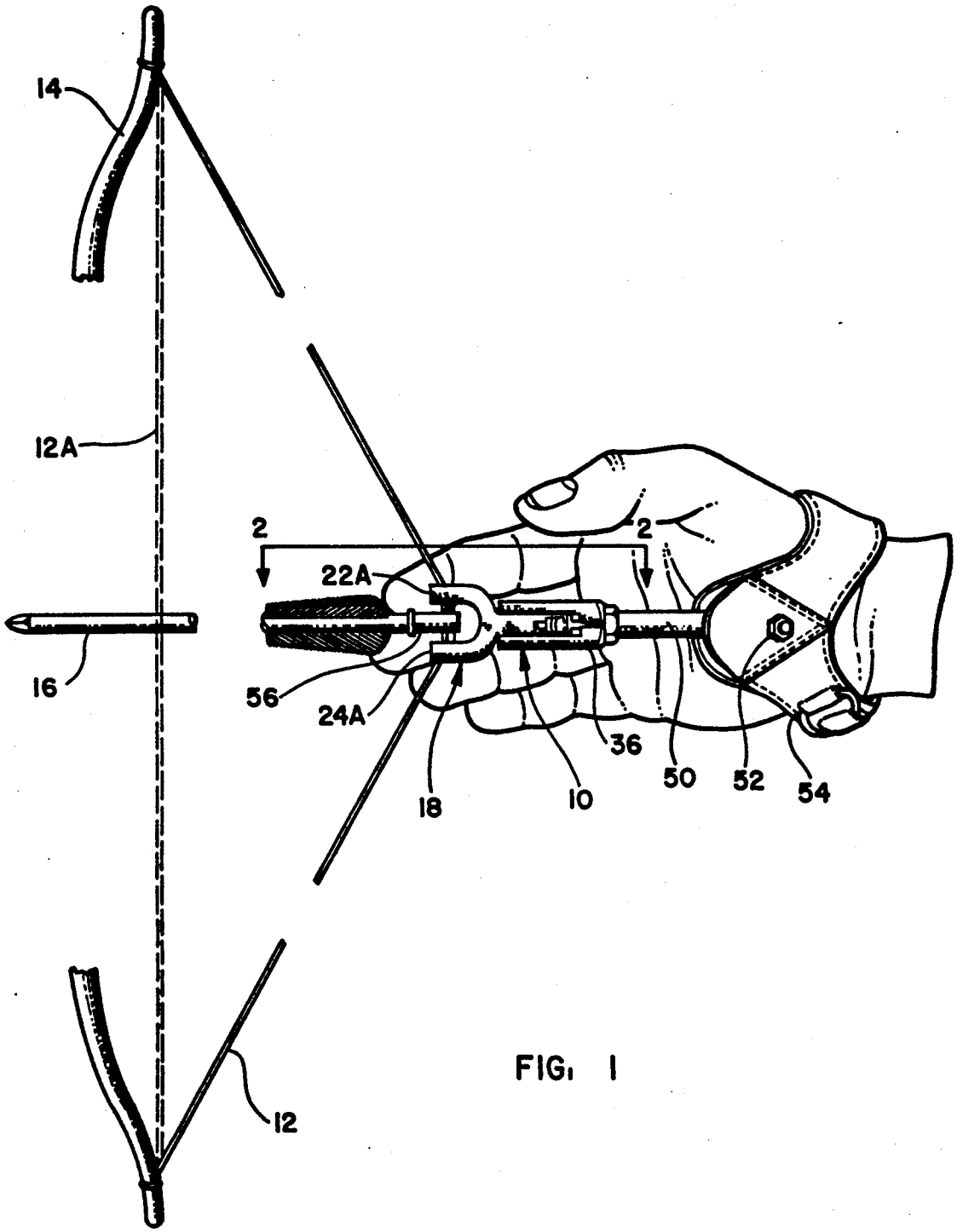
FIG. 1 is a side elevational view of a portion of an archery bow and an arrow to be propelled by the archery bow and showing the preferred embodiment of the bowstring release apparatus of the present invention.

The bowstring release apparatus 10 includes a first jaw means 18 and a second jaw means 20, each respective jaw means having an upper engagement portion 22A, 22B, respectively, and a lower engagement portion 24A, 24B, respectively, the upper and lower engagement portions defining therebetween a receiving space for receiving the nock of an arrow. As best seen in FIG. 1, the respective upper and lower engagement portions of each jaw means 18, 20 such as, for example, the upper engagement portion 22A and the lower engagement portion 24A of the first jaw means 18, are spaced from one another relative to the linear axis BA. The respective upper and lower engagement portions of each jaw means 18, 20 are integrally formed and are commonly joined at a trunk portion 26A, 26B, respectively. Each respective upper engagement portion 22A, 22B and each respective lower engagement portion 24A, 24B is formed with a recess 28 having a depth extending parallel to the lateral axis LA and an extent extending parallel to the flight axis FA toward the free end of the respective engagement portion and terminating in a relief surface 30 adjacent the nock receiving space.

Figure 3:
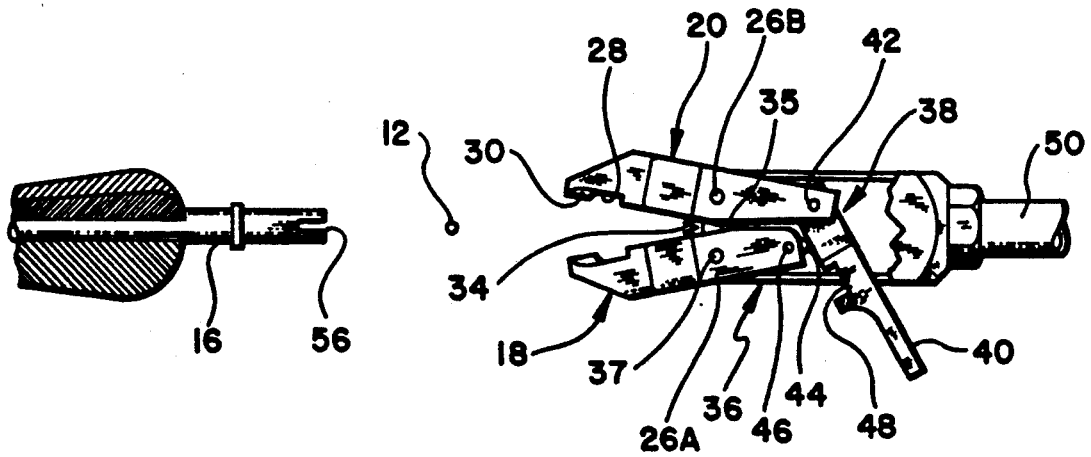
FIG. 3 is a top plan view of the bowstring release apparatus shown in FIG. 2, showing the apparatus in its bowstring release disposition.
Figure 4:
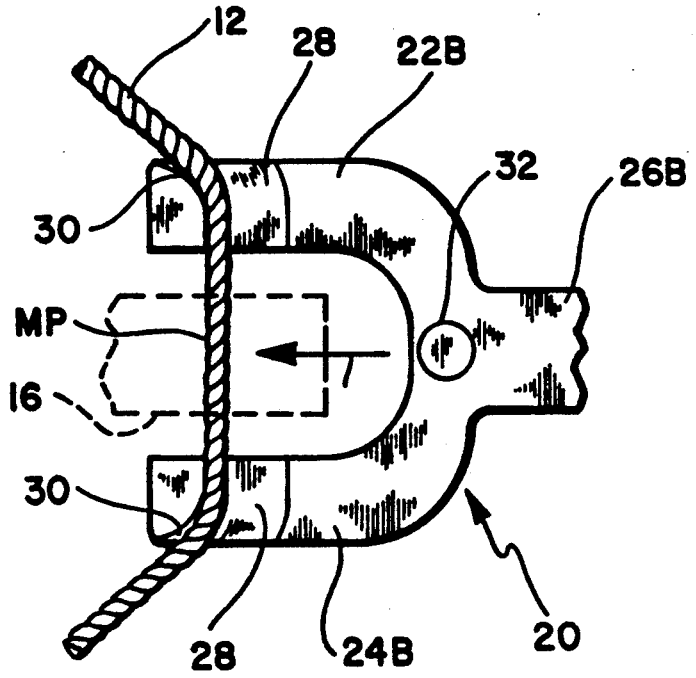
FIG. 4 is an enlarged side elevational view of a portion of one jaw of the bowstring release apparatus shown in FIG. 2.

As best seen in FIG. 4, each jaw means 18, 20 such as, for example, the second jaw means 20, includes a cylindrical recess 32 for receiving therein the end portion of a coil spring 34 (shown in FIG. 3) for a purpose to be described in more detail below. Additionally, each jaw means 18, 20 includes a spherical recess on its respective trunk portion 26A, 26B, spaced from the cylindrical recess 32 in the cocking direction, for movably receiving a conventional ball bearing 35 (shown in FIG. 3) for a purpose described in more detail below.

The bowstring release apparatus 10 additionally includes means 36 for supporting the jaw means 18, 20 for lateral movement. For this purpose, each jaw means 18, 20 is pivotally mounted on a pivot pin 37 for pivoting about an axis parallel to the linear axis BA. As can be understood, the jaw means 18, 20 move laterally toward or away from one another as they pivot about their respective pivot pins 37.

The bowstring release apparatus 10 also includes a conventional means 38 for individually moving the jaw means 18, 20 in laterally opposite directions. The moving means 38, as best seen in FIGS. 3 and 5, includes a trigger member 40 having one free end pivotally connected by a pivot pin 42 to the free end of the second jaw means 20 which is interiorly disposed in the support means 36. The free end of the first jaw means 18 disposed in the support means 36 includes a roller 44 rotatably connected thereto by a pivot pin 46 for rotation of the roller about an axis parallel to the linear axis BA. The trigger member 40 includes a recess 48 compatibly configured with the roller 44 and the interior free end of the first jaw means 18 to receive the free end and the roller therein. As best seen in FIG. 1, the support means 36 includes a rigid stem 50 which is coupled by a bolt and nut assembly 52 to a conventional wrist strap 54 such as disclosed, for example in U.S. Pat. No. 4,831,997.

In operation, the bowstring release apparatus 10 is initially in a condition with the jaw means 18, 20 in a bowstring release disposition, as seen in FIG. 3, in which the jaw means 18, 20 are spaced laterally away from one another. The coil spring 34 resiliently biases the jaw means 18, 20 about the ball bearing 35 such that the respective upper and lower engagement portions of the jaw means are laterally spaced from one another in the release disposition with the interior free ends of the jaw means 18, 20 positioned adjacent one another. As the interior free ends of the jaw means 18, 20 move toward one another the roller 44 rolls along the trigger member 40 to facilitate the smooth relative lateral movement of the jaw means 18, 20. Additionally, the archer has secured the wrist strap 54 about the wrist of his hand which will draw back the bowstring 12. While grasping the archery bow 14 with his other hand, the archer then loads the arrow 16 onto the bowstring 12 by disposing the midpoint MP of the bowstring 12 in the nock 56 of the arrow 16 while the bowstring is in its uncocked disposition 12A.

With the jaw means 18, 20 in their bowstring release disposition, the archer positions the bowstring release apparatus 10 adjacent the midpoint MP of the bowstring 12 and guides the bowstring release apparatus 10 with the thumb of his wrist strap hand to dispose the first jaw means 18 on one respective lateral side of the bowstring 12 and the second jaw means 20 on an opposed lateral side of the bowstring 12 such that the bowstring 12 is laterally intermediate the pair of jaw means 18, 20, relative to the flight axis FA, at about the same alignment as the recesses 28. The archer then manipulates the trigger member 40 with the thumb of his wrist strap hand to move the trigger member from the position shown in FIG. 3 to the position shown in FIG. 2. The movement of the trigger member 40 occurs through pivoting of the trigger member relative to the second jaw means 20 about the pivot pin 42. The pivoting of the trigger member 40 about the pivot pin 42 in a clockwise direction as viewed in FIG. 3, effects pivoting of the jaw means 18, 20 about the ball bearing 35 and against the bias of the coil spring 34 such that the jaw means 18, 20 move laterally toward one another. As the trigger member 40 pivots, the roller 44 rolls along the trigger member and is eventually received in the recess 48 of the trigger member 40. As can be understood, the recess 48 is appropriately located along the axial extent of the trigger member 40 such that the roller 44 enters the recess 48 as the jaw means 18, 20 complete their lateral movement toward one another at a position in which they are in generally aligned relation with one another.

Figure 2:
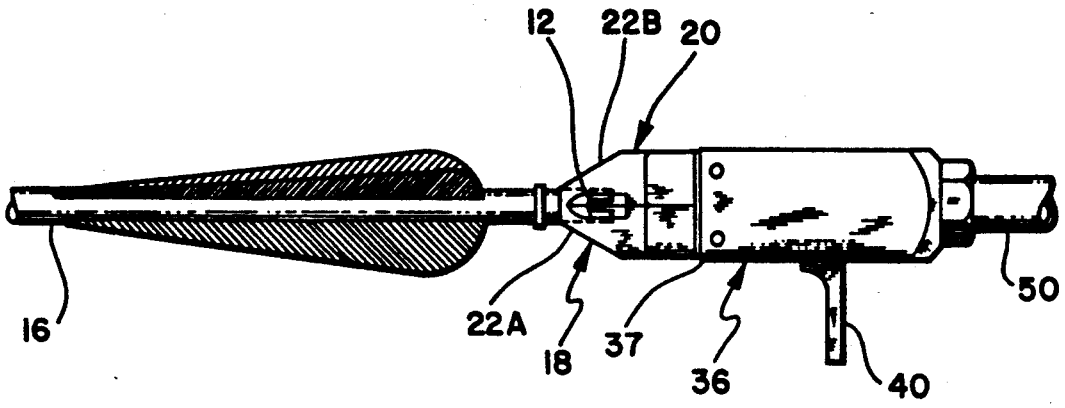
FIG. 2 is a top plan view of the bowstring release apparatus shown in FIG. 1, taken along lines 2—2 thereof.

When the roller 44 is received in the recess 48 of the trigger member 40, the jaw means 18, 20 are disposed in the bowstring drawing disposition, shown in FIG. 2, in which the respective upper engagement portions 22A, 22B are in generally aligned relation with one another and the respective lower engagement portions 24A, 24B are in generally aligned relation with one another with the bowstring 12 received in the pair of gaps formed by the respective recesses 28 of the upper and lower engagement portions. As is conventionally known, the movement means 38 can be configured such that the trigger member 40 automatically remains in the position shown in FIG. 2 in which it receives the roller 44 in its recess 48, without the need for the archer to maintain pressure against the trigger member 40.

With the bowstring 12 thus disposed in the pair of gaps formed by the jaw means 18, 20, the archer draws back his wrist strap hand to move the bowstring 12 from its uncocked disposition 12A to the bowstring cocked disposition shown in solid lines in FIG. 1. During this movement, as best seen in FIGS. 1 and 4, the bowstring 12 is engaged by the contoured engagement surfaces 30 of the jaw means 18, 20. Thus, a drawing force is applied to the bowstring 12 on both sides of the nock 56 in an arrow cocking direction parallel to the flight axis FA and opposite to the direction of flight of the arrow 16 and the two drawing forces are of substantially equal magnitude. Accordingly, the archer achieves a balanced drawback of the bowstring 12 without the need to compensate for any drawing forces which are offset from the midpoint MP of the bowstring 12. In effect, the drawing force applied against the bowstring 12 by the relief surfaces 30 of the upper engagement portions 22A, 22B are effectively counterbalanced by the drawing forces applied by the contoured engagement surfaces 30 of the lower engagement portions 24A, 24B.

Once the archer has properly aimed the arrow 16, the archer need only engage the trigger member 40 with the thumb of his wrist strap hand to effect release of the bowstring 12. Specifically, the archer pivots the trigger member 40 about the pivot pin 42 in a counterclockwise direction, as viewed in FIG. 3, to cause release of the roller 44 from the recess 48 to permit the coil spring 34 to automatically move the jaw means 18, 20 laterally away from one another to the bowstring release position shown in FIG. 3. Each jaw means 18, 20 moves laterally outwardly from the bowstring 12 in a substantially simultaneous manner, thereby minimizing undesirable lateral movement of the bowstring 12 along the lateral axis LA upon its release.

The bowstring release apparatus 10 provides the advantage that, if the archer decides not to release the bowstring 12 after cocking of the bowstring, the archer can return the bowstring 12 to its uncocked disposition 12A without fear that the arrow 16 will slip off the bowstring 12. Specifically, the jaw means 18, 20 limit movement of the arrow 16 along the linear axis BA, thereby acting to maintain the arrow 16 in its bowstring engaging disposition in which the nock 56 received the bowstring 12 therein.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A trigger apparatus for selectively releasing a bowstring of an archery bow from a cocked disposition to propel an arrow engaged thereon, the arrow being of the type having a nock engaging the bowstring and the bowstring being of the type extending linearly in an uncocked disposition of the archery bow and being movable from the uncocked disposition to the cocked disposition in an arrow cocking direction opposite to the direction of flight of the arrow, comprising:

a first jaw means having an upper engagement portion and a lower engagement portion spaced from said upper engagement portion in the linear direction of the bowstring, said upper and lower engagement portions of said first jaw means defining a linearly extending gap therebetween;

a second jaw means having an upper engagement portion and a lower engagement portion spaced from said upper engagement portion in the linear direction of the bowstring, said upper and lower engagement portions of said second jaw means defining a linearly extending gap therebetween;

means for supporting said first and second jaw means in opposed lateral disposition for movement of said first and second jaw means in respective opposite directions laterally of the bowstring; and means for individually moving said first and second jaw means in laterally opposite directions between a closed bowstring drawing disposition in which the respective upper and lower engagement portions define a receiving space therebetween for receiving the nock of the arrow therein upon engagement of the bowstring by the nock, and a bowstring release disposition to which said first and second jaw means have been moved laterally oppositely substantially simultaneously by said moving means for balanced release of the bowstring for propulsion of the arrow thereby, the trigger apparatus being movable, in said bowstring drawing disposition, to draw the bowstring into a cocked disposition, the linear extent of said linearly extending gaps being greater than the linear extent of the arrow nock and said linearly extending gaps extending sufficiently laterally outwardly and rearwardly beyond the respective pairs of said upper and lower engagement portions of said first and second jaw means for form combined lateral and rearward extending gaps which are greater than the lateral and rearward extent of the arrow nock, wherein the relatively greater linear, lateral and rearward extents of said gaps with respect to the arrow nock permit said first and said second jaw means to be spaced from an arrow nock of an arrow engaged with said bowstring when in said bowstring engaging disposition and to move between said bowstring engaging and release dispositions out of interference with an arrow engaged with the bowstring.

2. A trigger apparatus according to claim 1 and characterized further in that said upper and lower engagement portions of said first jaw means are integrally formed and said upper and lower engagement portions of said second jaw means are integrally formed.

3. A trigger apparatus according to claim 2 and characterized further in that said upper and lower engagement portions of said first and second jaw means include complementary recesses for engaging the bowstring in said bowstring drawing disposition.

4. A trigger apparatus according to claim 3 and characterized further in that said first and second jaw means include bowstring engaging surfaces forming the leading surfaces of said complementary recesses relative to the direction of travel of the arrow.

5. A trigger apparatus according to claim 4 and characterized further in that said bowstring first and second engaging surfaces have relief contours adjacent said receiving space.

6. A trigger apparatus according to claim 1 and characterized further in that said means for supporting said first and second jaw means includes a pair of pivotal components, each pivotal component pivotally mounting a respective one of said first and second jaw means for pivotal movement of the respective jaw means about a pivoting axis generally parallel to the linear direction of the bowstring.

7. A trigger apparatus according to claim 6 and characterized further in that said moving means includes biasing means disposed between said first and second jaw means for biasing said first and second jaw means into said bowstring release disposition.

* * * * *

UNITED STATES PATENT AND TRADEMARK OFFICE

CERTIFICATE OF CORRECTION

PATENT NO. : 5,020,508

DATED : June 4, 1991

INVENTOR(S) : John F. Greene, Jr.

It is certified that error appears in the above-identified patent and that said Letters Patent is hereby corrected as shown below:

Title Page:

Abstract, Line 14, reads "and" (second occurrence) but should read -- the --.

Column 2, Line 3, reads "an" but should read -- and --.

Column 2, Line 14, reads "&he" but should read -- the --.

Column 2, Line 28, after "moving" add -- means --.

Column 2, Line 49, after "extend" add -- laterally outwardly beyond the respective pairs of the upper and --.

Column 4, Line 52, after "for example" add -- , --.

Column 4, Line 65, after "another" add -- , --.

Column 7, Line 32, reads "for" but should read -- to --.

Signed and Sealed this

Eighth Day of December, 1992

*Attest:*

DOUGLAS B. COMER

*Attesting Officer*

*Acting Commissioner of Patents and Trademarks*